US005320592A

United States Patent [19]

Olschansky et al.

[11] Patent Number: 5,320,592

[45] Date of Patent: Jun. 14, 1994

[54] ADJUSTABLE AND COLLAPSIBLE BENCH SYSTEM

[76] Inventors: Brad Olschansky, 1900 Rambling Ridge La., #202, Baltimore, Md. 21209; Scott Olschansky, 8415 Bellona La., #404, Towson, Md. 21204; Raymond H. Lee, Jr., Lutherville, all of Md.

[21] Appl. No.: 855,925

[22] Filed: Mar. 23, 1992

[51] Int. Cl.[5] ..... A63B 26/00

[52] U.S. Cl. ..... 482/142; 482/144; 482/148

[58] Field of Search ..... 482/142, 94, 133, 143-145, 482/108, 140; 248/456; 108/1; 297/377

[56] References Cited

U.S. PATENT DOCUMENTS

| | | | |
|---|---|---|---|
| 562,138 | 6/1896 | Marhoff | 248/456 |
| 4,084,849 | 4/1978 | Ishida et al. | 297/377 |
| 4,316,609 | 2/1982 | Silberman | 482/133 |
| 4,598,908 | 7/1986 | Morgan | 482/94 |
| 4,826,157 | 5/1989 | Fitzpatrick | 482/133 |

FOREIGN PATENT DOCUMENTS

| | | | |
|---|---|---|---|
| 3417719 | 1/1985 | Fed. Rep. of Germany | 482/140 |

*Primary Examiner*—Richard J. Apley
*Assistant Examiner*—Jerome Donnolly
*Attorney, Agent, or Firm*—Morton J. Rosenberg; David I. Klein

[57] ABSTRACT

An adjustable and collapsible bench system (10) is provided for supporting the body of a user while allowing a plurality of orientations to be fixed at the user's behest. The bench system (10) includes a body support mechanism (16) which is adjustably mounted on a base frame mechanism (24). The body support mechanism (16) may be rotationally actuated with respect to the base frame mechanism (24) and releasably secured to the base frame mechanism (24) to provide a plurality of angular orientations of the body support mechanism (16) with respect to the base surface (12). The body support mechanism (16) may be rotationally collapsed to allow for a minimization of the dimensional volume of the bench system (10).

19 Claims, 3 Drawing Sheets

ADJUSTABLE AND COLLAPSIBLE BENCH SYSTEM

BACKGROUND OF THE INVENTION

1. Field of the Invention

This invention relates to benches adapted to support the weight of a user. In particular, this invention directs itself to bench systems wherein the user may sit or lie at varying angles with respect to a base surface and use differing muscle groups for exercise purposes. Still further, in particular, this invention relates to an adjustable and collapsible bench system including a body support mechanism which is displaceable in a plurality of directions to particularly orient and position the user in a predetermined and varying orientation with respect to an external structure and/or a base surface. More in particular, this invention relates to a bench system having rotational mechanisms which allows the body support mechanism to be moved longitudinally and inclined at a plurality of angles. Still further, this invention directs itself to a bench system where rotational displacement mechanisms allow the bench system to be collapsed into a substantially planar contour to reduce the dimensional extent of the bench system for either transportation or storage purposes. Still further, this invention relates to a bench system which is stabilized on a base surface through a stabilizing frame which is secured to a leg member which in itself interfaces with the base surface. More in particular, this invention relates to a bench system whereby a central base frame mechanism incorporates an L-shaped beam construction whereby the body support mechanism 16 may be mounted to the base frame mechanism at a plurality of locations to increase the orientation variability of the body support mechanism.

2. Prior Art

Bench systems for use with exercising devices or otherwise are well known in the art. Adjustable bench systems are also known however, in some prior art systems, the body support mechanism is movable only between a limited number of inclined angles. In such prior art systems, a singular dimensional displacement of the body support mechanism limits the different types of exercise activities for which the prior art bench systems may be used. Furthermore, in other prior art systems employing full size benches, mechanisms are not provided to allow for collapse of the bench to reduce the overall dimensional extent of the bench for either transportation and/or storage.

SUMMARY OF THE INVENTION

An adjustable and collapsible bench system is provided for supporting a user mounted thereon in a plurality of orientations with respect to a base surface. The adjustable and collapsible bench system includes a body support mechanism for interfacing with the body of the user with the body support mechanism extending in a longitudinal direction. A base frame is rotationally coupled to the body support mechanism for stabilizing the adjustable and collapsible bench system on the base surface. Additionally, a mechanism for rotationally and longitudinally displacing the body support mechanism is provided for positioning the body support mechanism at a predetermined angle with respect to the base surface.

DESCRIPTION OF THE PREFERRED EMBODIMENTS

Figure 3:
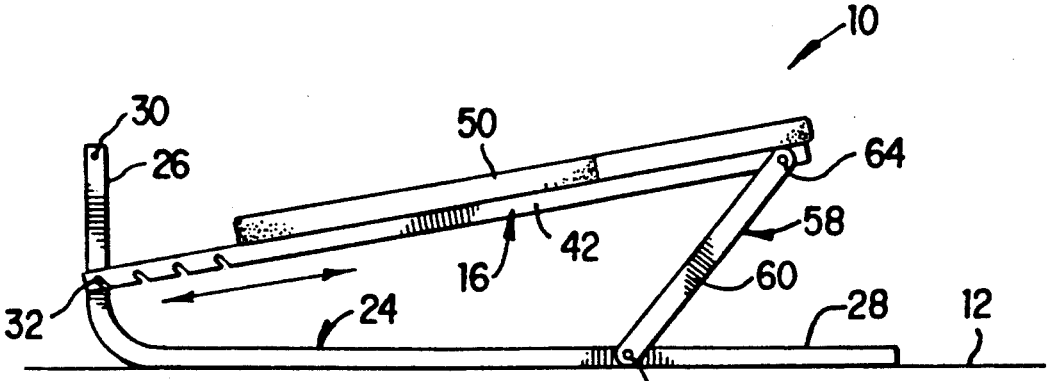
FIG. 3 is an elevational view of the adjustable and collapsible bench system of the present invention concept showing the body support mechanism in a steeply inclined position.
Figure 4:
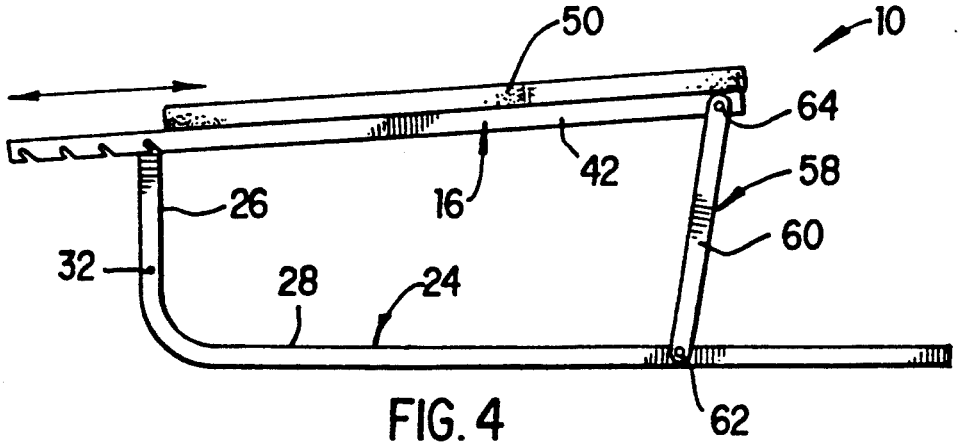
FIG. 4 is an elevational view of the adjustable and collapsible bench system of the present invention concept showing the body support mechanism in a forwardly extending position with a less inclined mounting than that shown in FIG. 3.
Figure 5:
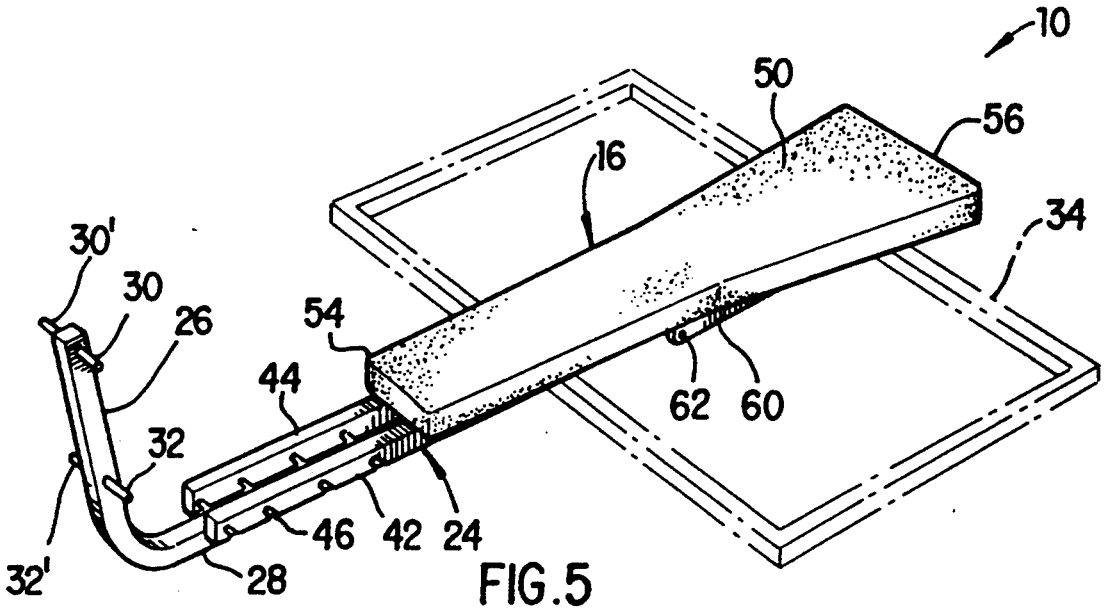
FIG. 5 is a perspective view of the present invention concept showing the bench system in a collapsed position; and, FIG. 6 is a frontal elevational view of the adjustable and collapsible bench system of the subject invention concept in a fully extended positional orientation corresponding to FIG. 1.

Referring now to FIGS. 1–6, there is shown adjustable and collapsible bench system 10 for interface with a user's body mounted thereon. Adjustable and collapsible bench system 10 is adapted to be angularly oriented at predetermined angular orientations with respect to base surface 12 upon which system 10 is mounted. In particular, bench system 10 may be angularly oriented to predetermined angular inclinations as shown in FIGS. 3 and 4 and further, may be collapsed to a position as shown in FIG. 5 for ease of storage and/or transportation at the behest of the user.

Figure 1:
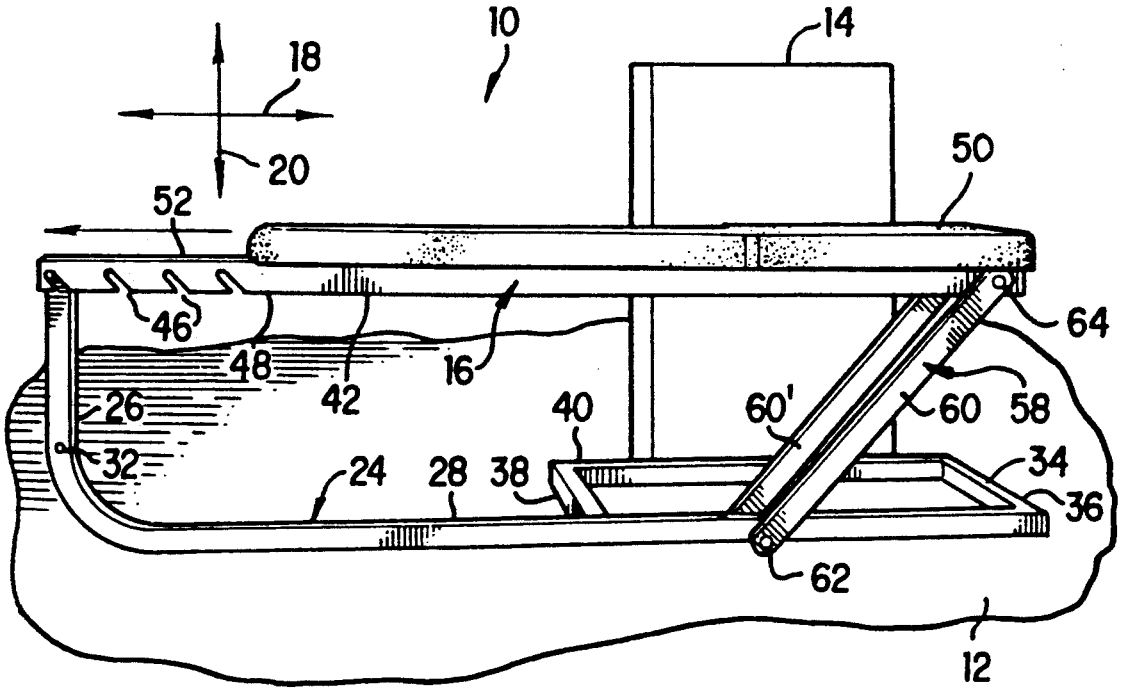
FIG. 1 is a perspective elevational view of the adjustable and collapsible bench system of the present invention concept showing the bench system in its fully extended position.
Figure 2:
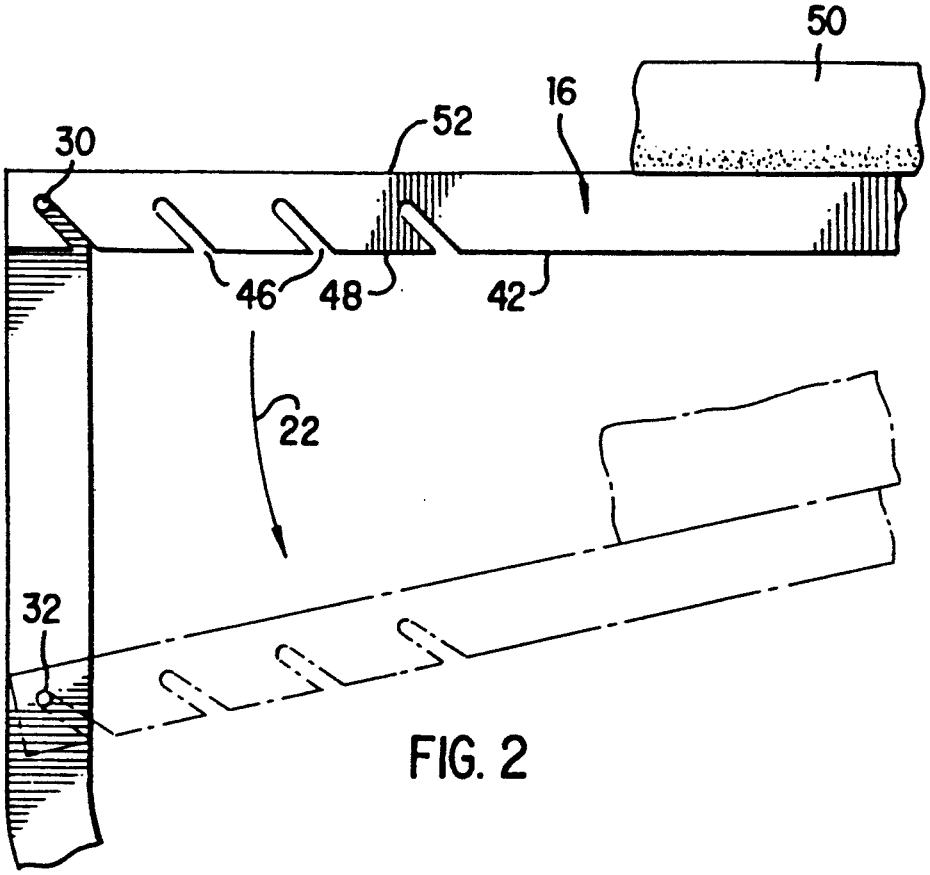
FIG. 2 is an elevational partially cut-away view of the adjustable and collapsible bench support mechanism showing displacement of the body support mechanism in a plurality of position.

In order to show usage of bench system 10, FIG. 1 shows system 10 mounted adjacent external structure 14 which may be an exercising machine or some other mechanism being used by the user. External structure 14 merely shows the relationship in positioning between system 10 and some device upon which the user may operate. In particular, bench system 10 allows the user to incline the bench at particular angular orientations to allow strengthening or use of particular muscle areas in the user's body. However, external structure 14 is not part of the inventive concept as is herein described and is only shown in FIG. 1 to provide a positional relationship between bench system 10 and some external structure 14 during usage.

It is further to be understood that bench system 10 is in general directed to an adjustable and collapsible bench system 10 which is not solely adapted for use with exercising devices but has a wide utility in the support of a user's body at particular angular orientations with respect to base surface 12.

Adjustable and collapsible bench system 10 includes body support mechanism 16 which interfaces with the body of a user. Body support mechanism 16 as seen in FIGS. 1, 3–5 extends in longitudinal direction 18 and is displaced from base surface 12 in vertical direction 20. As will be seen in following paragraphs, body support mechanism 16 is adapted to be rotationally displaced in relation to arcuate direction 22 shown in FIG. 2 for predeterminately orienting body support mechanism 16 with respect to base surface 12.

Adjustable and collapsible bench system 10 further includes base frame mechanism 24 rotationally coupled to body support mechanism 16 for stabilizing adjustable and collapsible bench system 10 on base surface 12. Base frame mechanism 24 includes an overall substantially L-shaped contour as is seen in FIGS. 1, and 3–5. L-shaped base frame mechanism 24 includes first leg member 26 extending in substantially vertical direction 20 and second leg member 28 extending in longitudinal direction 18 as shown in FIG. 1. Base frame second leg member 28 is adapted to substantially contiguously interface with base surface 12 to provide a stabilization for bench system 10. First and second leg members 26 and 28 are either formed in one piece formation or otherwise secured each to the other to provide a substantially unitary construction. Leg members 26 and 28 may be formed of steel, aluminum, or some other composition not important to the inventive concept as herein described with the exception that such composition allow for structural integrity throughout a user operating force loading condition. Additionally, both first and second leg members 26 and 28 may be formed of a bar member construction having a substantially rectangular contour in cross-section. In this manner there is provided base frame mechanism 24 having an extended length which interfaces with base surface 12 and a frontal portion which includes first leg member 26 extending in vertical direction 20 as is most clearly seen in FIGS. 1 and 3.

First leg member 26 includes a mechanism for releasably securing body support mechanism 16 to first leg member 26. The releasable securement mechanism for releasably securing body support mechanism 16 to first leg member 26 includes a first pair of first leg peg or insert members 30, 30' which extend transversely from opposing surfaces of base frame first leg member 26 as is seen in FIGS. 3–5. First pair of first leg peg members 30, 30' may be formed of steel or some like composition sufficient to support the force loading applied thereto by body support mechanism 16. First pair of first leg peg members 30, 30' are located at an uppermost portion of first leg member 26 as is shown and is positioned to permit body support mechanism 16 to be mounted thereon. Second pair of first leg peg members 32, 32' are secured on opposing transverse surfaces of base frame first leg member 26 as is clearly seen in FIG. 5. Second pair of first leg peg members 32, 32' extend in a transverse direction from opposing transverse sides of first leg member 26 and second pair of first leg peg members 32, 32' are vertically displaced from first pair of first leg peg members 30, 30'. Second pair of first leg peg members 32, 32' are secured at a lower sectional section of first leg member 26. Both first and second pairs of first leg peg members 30, 30' and 32, 32' are fixedly secured to opposing transverse surfaces of first leg member 26 in a rigid manner and are adapted to support weight loadings applied to body support mechanism 16 as has hereinbefore been described. Peg members 30, 30' and 32, 32' may be cylindrical in contour and circular in cross-sectional contour to provide ease of insertion of mating sections of body support mechanism 16.

Adjustable and collapsible bench system 10 includes base stabilizing frame 34 secured to base frame second leg 28. Base stabilizing frame 34 extends in a transverse direction with respect to longitudinal direction 18 as is seen in FIG. 1 and interfaces with base surface 12 to provide a stabilized mounting for adjustable and collapsible bench system 10. Base stabilizing frame 34 includes base stabilizing end beam members 36 and 38 as shown in FIG. 1 and further may include base stabilizing side beam member 40. Base stabilizing end beams 36, 38 and base stabilizing side beam 40 are substantially planar in relation each to the other in order to provide a substantially planar surface for interfacing with base surface 12. Base stabilizing end beams 36 and 38 may be fixedly secured to second leg member 28 through welding, bolting or some like securement technique not important to the inventive concept as herein described. Additionally, base stabilizing beams 36, 38 and 40 may be formed in one piece formation to provide an overall stabilization for bench system 10 when mounted on base surface 12. As can be seen, base stabilizing frame 34 provides for a transverse dimension to the overall bench system 10 which provides for stabilization when transverse loads are applied to adjustable and collapsible bench system 10. As seen in FIG. 5 in phantom drawing, base stabilizing frame 34 may be formed or contoured to provide transverse dimensional length on opposing transverse sides of second leg member 28 to increase stabilization.

Figure 6:
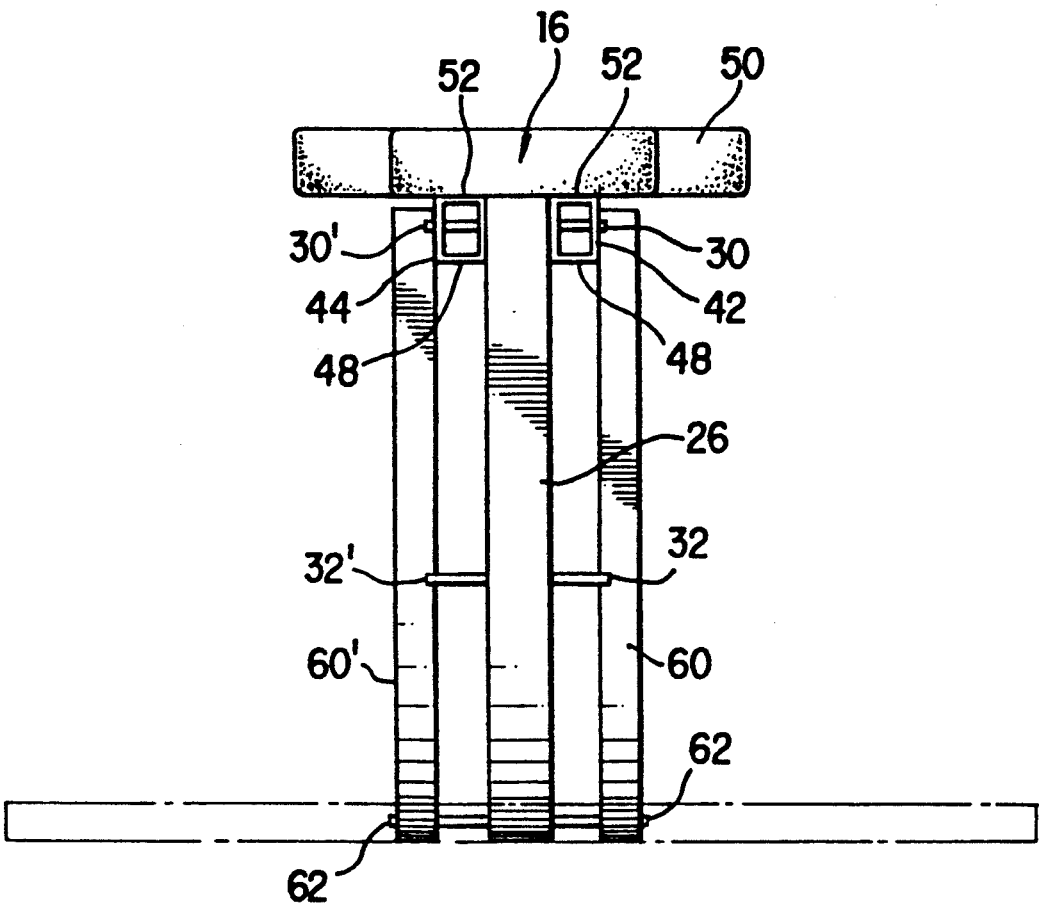

Body support mechanism 16 includes first longitudinally extending body support beam 42 clearly seen in FIGS. 1–5 and second longitudinally extending body support beam 44 shown in FIG. 6. First and second longitudinally extending body support beams 42 and 44 include a mechanism for releasably securing each of longitudinally extending body support beam members 42 and 44 to first leg member 26 of L-shaped base frame mechanism 24. The mechanism for releasably securing body support beams 42 and 44 include a plurality of notches 46 displaced each from the other in longitudinal direction 18. As can be seen, notches 46 are angularly cut or formed through lower surfaces 48 of respective first and second longitudinally extending body support beams 42 and 44. Angular orientation of notches 46 provide for releasable securement of either first pair of first leg peg members 30, 30' or second pair of first leg peg members 32, 32' within notches 46 as required and further provides for increased stabilization of overall body support mechanism 16 when having force loads applied thereto.

As can be seen in FIGS. 1, 3 and 4, the longitudinal displacement of notches 46 allows for interface with particular peg members 30, 30' and 32, 32' and further allows for differing angular orientations of body support mechanism 16 with relation to base surface 12. Differing angular orientations of body support mechanism 16 may be associated with particular exercises being accomplished by the user to exercise particular or individual muscle groups.

Body support mechanism 16 further includes body support member 50 which is substantially planar in contour and is secured to upper surfaces 52 of body support beams 42 and 44. Body support member 50 is a substantially planar member which is fixedly secured to upper surfaces 52 of first and second longitudinally extending body support beams 42 and 44 in a fixedly secured manner well known in the art. Body support member 50 may include a rigid planar base member covered with fabric or some other resilient type mounting for comfort of a user who may be lying on body support member 50 during an exercise session.

Referring to FIG. 6, first and second longitudinally extending body support beams 42 and 44 may be box beam construction members which are transversely displaced each from the other by the transverse dimension of first leg member 26 to allow each of body support beams 42 and 44 to be displacingly moved on opposing transverse sides of first leg member 26. In this manner, body support beams 42 and 44 may be displaced in an arcuate direction as provided by arcuate directional arrow 22 of FIG. 2.

Additionally, as is seen in FIGS. 1–4, particular notches 46 may be used in conjunction with pegs 30, 30' and 32, 32' to provide a predetermined inclined orientation of body support mechanism 16 with respect to base surface 12.

As seen in FIG. 5, body support member 50 extends in longitudinal direction 18 and includes a planar contour whereby body support member first end 54 has a smaller transverse dimension than body support member second end 56. In this manner, a user may lie on body support member 50 and have an increased interface area with the user's back while allowing the user's legs to straddle body support member 50 and first and second longitudinally extending body support beams 42 and 44.

Bench system 10 includes rotational and longitudinal displacement mechanism 58 for displacing body support mechanism 16 and for positioning body support mechanism 16 at a predetermined angle with respect to base surface 12. Rotational and longitudinal displacement mechanism 58 includes a pair of body support rotational bar members 60, 60' which are pivotally coupled at pivot point 62 to second leg member 28 and body support mechanism 16 at pivot point 64. Lower and upper pivot points 62 and 64 may simply be pin members extending through second leg member 28 on opposing transverse sides thereof and rotationally coupled to body support rotational bar members 60, 60' as is seen in FIG. 1. Additionally, upper pivot point 64 may also include a pin member passing through a first longitudinally extending body support beam 42 on opposing transverse sides thereof to allow rotative coupling to body support rotational bar members 60, 60'. In this manner, there is provided an overall mechanism whereby body support mechanism 16 may be rotationally moved or displaced with respect to base frame mechanism 24 as has previously been described.

As seen in FIG. 5, first and second longitudinally extending body support beams may be removed from securement with peg members 30, 30' and 32, 32' and collapsed into a substantially planar positional location to allow ease of storage or transportation. In this manner, body support mechanism 16 is collapsed by removal of pegs 30, 30' and 32, 32' from respective notches 46 and body support rotational bar members 60, 60' are rotated in a clockwise direction when taken with respect to FIGS. 3 and 4 to allow a collapsible positioning of bench system 10 as is shown. Each of elongated slots 46 as has hereinbefore been described are inclined at an angle that approximates 45 degrees. The inclination of slots 46 allows such to easily receive and engage any elongated pin member 30, 30' and 32, 32' extending from opposing transverse surfaces of first leg member 26. The pivoting aspect provided by rotational and longitudinal displacement mechanism 58 allows the user to displace body support mechanism 16 in a longitudinal and rotational direction for engaging any pair of slots 46 with any of the pin or peg members 30, 30', 32 and 32'. The ability of the rotational translation allows the user to move body support mechanism 16 in a plurality of directions and allows the user of the bench system 10 a large number of variational positions in which to place and position body support mechanism 16.

Although the invention has been described in connection with specific forms and embodiments thereof, it will be appreciated that various modifications other than those discussed above may be resorted to without departing from the spirit or scope of the invention. for example, equivalent elements may be substituted for those specifically shown and described, certain features may be used independently of other features, and in certain instances, particular locations of elements may be reversed or interposed, all without departing from the spirit or scope of the invention as defined in the appended claims.

What is claimed is:

1. An adjustable and collapsible bench system for supporting a user mounted thereon in a plurality of orientations with respect to a base surface, comprising:

(a) body support means for interfacing with the body of said user, said body support means extending in a longitudinal direction;

(b) a base frame coupled to said body support means for stabilizing said adjustable and collapsible bench system on said base surface, said body support means being rotationally coupled to said base frame; and, (c) means for rotationally and longitudinally displacing said body support means for positioning said body support means at a predetermined angle with respect to said base surface, said body support means being removeably coupled to a substantially vertically directed first leg member of said base frame and pivotally and fixedly coupled to a second leg member of said base frame extending substantially in said longitudinal direction. said body support means having at least one notch formed within a lower surface thereof, for co-operating with an insert member secured to said first leg member.

2. The adjustable and collapsible bench system as recited in claim 1 where said base frame is substantially L-shaped in contour in elevational cross-section.

3. The adjustable and collapsible bench system as recited in claim 2 where said L-shaped base frame first leg member extends in said substantially vertical direction and said second leg member extends in said longitudinal direction for substantial contiguous interface with said base surface.

4. The adjustable and collapsible bench system as recited in claim 3 where said first and second leg members are secured each to the other in one piece formation.

5. The adjustable and collapsible bench system as recited in claim 3 where said first and second leg members are extended beam members formed in one piece construction.

6. The adjustable and collapsible bench system as recited in claim 3 including at least a first pair of first leg peg members extending transversely from opposing surfaces of said first leg member.

7. The adjustable and collapsible bench system as recited in claim 6 including at least a second pair of first leg peg members extending transversely from opposing surfaces of said first leg member, said second pair of first leg peg members being vertically displaced from said first pair of first leg peg members.

8. The adjustable and collapsible bench system as recited in claim 3 including a base stabilizing frame member secured to said second leg member, said base stabilizing frame extending transverse said second leg member for interface with said base surface.

9. The adjustable and collapsible bench system as recited in claim 3 where said body support means includes:

(a) at least a first longitudinally extending body support beam member having an upper surface and a lower surface; and (b) a body support substantially planar member secured to said upper surface of said longitudinally extending body support beam member.

10. The adjustable and collapsible bench system as recited in claim 10 wherein said insert member is at least one peg member extending transverse from said first leg member.

11. The adjustable and collapsible bench system as recited in claim 9 including at least a second longitudinally extending body support beam member fixedly secured and transversely displaced from said first longitudinally extending body support beam member having an upper surface and a lower surface.

12. The adjustable and collapsible bench system as recited in claim 11 including at least one notch formed through each of said lower surfaces of said first and second longitudinally extending body support beam members for insert therein of a pair of peg members extending from opposing surfaces of said first leg member.

13. The adjustable and collapsible bench system as recited in claim 12 including a plurality of notches formed through said lower surfaces of said first and second longitudinally extending body support beam members, said notches being displaced each from the other by a predetermined distance in said longitudinal direction.

14. The adjustable and collapsible bench system as recited in claim 9 where said body support substantially planar member is fixedly secured to said first longitudinally extending body support beam member.

15. The adjustable and collapsible bench system as recited in claim 14 where said body support substantially planar member includes opposing longitudinal ends, one of said opposing longitudinal ends having a transverse dimension greater than a transverse dimension of said base frame and less than a transverse dimension of said opposing longitudinal end.

16. The adjustable and collapsible bench system as recited in claim 3 where said means for rotationally and longitudinally displacing said body support means includes at least one body support rotational bar member pivotally coupled to said second leg member and said body support means on opposing ends thereof.

17. The adjustable and collapsible bench system as recited in claim 3 including at least a second body support rotational bar member pivotally coupled to said second leg member and said body support means on opposing ends thereof.

18. The adjustable and collapsible bench system as recited in claim 3 where said body support means may be adjustably inclined with respect to said base surface.

19. The adjustable and collapsible bench system as recited in claim 3 where said body support means is rotatable to a positional location adjacent said second leg of said base frame.

* * * * *